US006010127A

United States Patent [19]

DiCesare et al.

[11] Patent Number: 6,010,127

[45] Date of Patent: Jan. 4, 2000

[54] INTERNAL PURGE FOR EASY JAM CLEARANCE IN COPIERS/PRINTERS

[75] Inventors: Cesidio J. DiCesare, Rochester; John D. Gramlich, Webster; Lisbeth S. Quesnel, Pittsford; Murray O. Meetze, Jr.; Leroy A. Baldwin, both of Rochester; Charles E. Smith, Pittsford; Keith L. Willis, Rochester, all of N.Y.

[73] Assignee: Xerox Corporation, Stamford, Conn.

[21] Appl. No.: 08/834,643

[22] Filed: Apr. 14, 1997

[51] Int. Cl.[7] ..... B65H 7/02; B65H 9/04; B65H 5/22

[52] U.S. Cl. ..... 271/259; 271/258.01; 271/242; 271/3.19; 271/301

[58] Field of Search ..... 271/3.19, 4.01, 271/242, 301, 303; 209/258.01, 258.03, 259, 273, 242

[56] References Cited

U.S. PATENT DOCUMENTS

| | | | |
|---|---|---|---|
| 3,588,472 | 6/1971 | Glaster et al. | 235/92 |
| 3,819,266 | 6/1974 | Price | 355/64 |
| 3,944,794 | 3/1976 | Reehil et al. | 235/92 SB |
| 4,078,787 | 3/1978 | Burlew et al. | 271/3.1 |
| 4,231,567 | 11/1980 | Ziehm | 271/259 |
| 4,958,823 | 9/1990 | Iwaki et al. | 271/110 |
| 5,257,070 | 10/1993 | Miller et al. | 271/301 |
| 5,313,258 | 5/1994 | Nishi | 271/301 |
| 5,356,263 | 10/1994 | Miller | 271/3.19 |
| 5,532,793 | 7/1996 | Kogure | 271/184 |
| 5,543,909 | 8/1996 | Quesnel | 271/228 |
| 5,652,942 | 7/1997 | Iseki | 399/21 |

FOREIGN PATENT DOCUMENTS

| | | |
|---|---|---|
| 58-143 349 | 8/1983 | Japan . |
| 61-156 152 | 7/1986 | Japan . |
| 3-120 139 | 5/1991 | Japan . |
| 6-219 598 | 8/1994 | Japan . |
| 7-053 088 | 2/1995 | Japan . |

*Primary Examiner*—Donald P. Walsh
*Assistant Examiner*—Daniel K Schlak

[57] ABSTRACT

An enlarged buckle chamber is positioned within an easily accessible, copy sheet transport path and used to compile sheets during fault cycle down in copiers/printers whenever sheets are prevented from reaching the output in sequence by jammed sheets. The user can then clear most jams by accessing the jam area plus the "easy to reach" area where internally purged sheet are gathered, thereby avoiding having paper distributed all over the paper path.

3 Claims, 3 Drawing Sheets

INTERNAL PURGE FOR EASY JAM CLEARANCE IN COPIERS/PRINTERS

BACKGROUND OF THE INVENTION

1. Field of the Invention

This invention relates to copiers/printers, and more particularly, to an improved method and apparatus for easing the clearance of jammed sheets in copiers/printers.

2. Description of the Prior Art

In copier/printer machines, paper jams have long been a burden to users. When a paper jam occurs, the user is required to take some action to restore the system to working order and to recover the integrity of the particular job. Heretofore, various strategies and features have been developed to reduce the occurrence of jams and to minimize the burden on the user to recover from the jam. Some of these strategies include: early detection of fault conditions; controlled cycle down and cycle up of machines; purging "bad" sheets which may be damaged or out of sequence to a destination where they are easily recognized and separated from "good" sheets; and minimizing the number of steps and the number of sheets and the difficulty of removing paper from the jammed machine.

Typically, sheets downstream from the jam are delivered as good, and sheets upstream from the jam must be removed by an operator along with the jammed sheets (or they are purged on cycle up). Purged sheets must then be recognized by the user as "bad" and discarded or recycled. Dedicating an output destination as a "purge tray" facilitates the recognition of purged sheets, but such a dedicated tray may be viewed as costly and wasteful. Distinguishing purged sheets by offsetting them from other sheets in an output tray can be wasteful if there are other sheets in the compiler for stapling (which must be sacrificed for job integrity).

Thus, there is still a clear need for an improved jam clearance system.

Various prior art structures are known for detecting and remedying jam situations including U.S. Pat. No. 3,588,472, which discloses a system wherein the number of recorded sheets entering a transport path of a reproduction apparatus are monitored along with the number of copies regressing from the transport path. These respective numbers are compared with the number of copies desired, and this comparison is utilized to provide a net count in a counter to indicate the number of originals from which the requisite number of copies have been made, completed, and delivered to a sorting area. In U.S. Pat. No. 3,819,266, a copying system incorporates means to stop the system in the event of a jam. A control is provided to inhibit restarting of the system except for recycling of the document handler until the malfunction is corrected. A method is disclosed in U.S. Pat. No. 3,944,794, of programming a reproduction machine to compensate for copies lost or destroyed as a result of a paper jam during a copy run.

Included by reference herein is U.S. Pat. No. 4,078,787, which discloses a paper jam technique in a copier that causes a complete shutdown of the machine. Copier jam recovery is accomplished by opening the machine access covers, removing the jammed sheets, and closing he covers. In U.S. Pat. No. 4,231,567, a method and apparatus for clearing jams in the transport path of a copier includes the steps of sensing a jam, clustering in-process sheets either at the jam location or at an area upstream of the jam location while simultaneously allowing sheets downstream of the jam location to continue out into a catch tray and removing the jammed sheets after the last downstream sheet has exited the copier and the machine has stopped.

SUMMARY OF THE INVENTION

Accordingly, an enlarged, open, buckle chamber is positioned within an easily accessible, copy sheet transport path and used to compile sheets during fault cycle down in copiers/printers whenever sheets are prevented from reaching the output of the machines in sequence by jammed sheets. A user can then clear most jams by accessing the jam area plus the "easy to reach" buckle chamber where internally purged sheets are gathered, thereby avoiding having paper distributed all over the paper path. In particular jam situations, copy sheets in a duplex loop are collected within the buckle chamber as well.

DESCRIPTION OF THE DRAWINGS

All of the above-mentioned features and other advantages will be apparent from the example of one specific apparatus and its operation described hereinbelow. The invention will be better understood by reference to the following description of this one specific embodiment thereof, which includes the following drawing figures (approximately to scale) wherein.

DETAILED DESCRIPTION OF THE PREFERRED EMBODIMENT

The invention will now be described by reference to a preferred embodiment of the internal purge stalled-roll registration buckle chamber of the present invention preferably for use in a conventional copier/printer. However, it should be understood that the internal purge stall-roll registration buckle chamber method and apparatus of the present invention could be used with any machine environment in which transport of sheets is desired.

Figure 1:
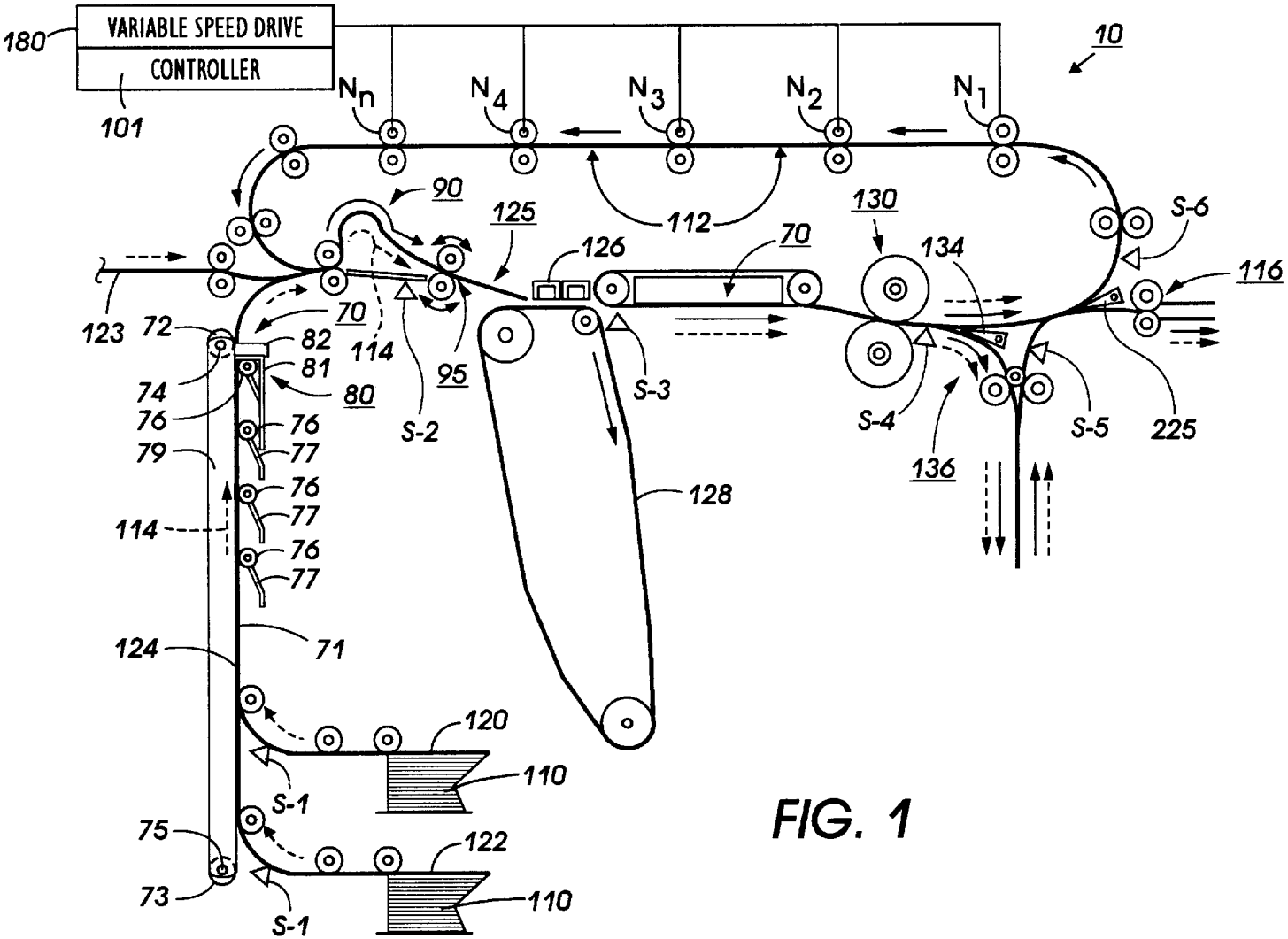
FIG. 1 is a schematic elevation view of an illustrative printing machine incorporating the accessible copy sheet transport buckle chamber of the present invention.

For a general understanding of the features of the present invention, reference is made to the drawings. In the drawings like reference numerals have been used throughout to designate identical elements. FIG. 1 schematically depicts the various components of an illustrative electrophotographic printing machine incorporating the internal purge stall-roll registration method and apparatus of the present invention therein.

Describing first in further detail the exemplary printer embodiment with reference to FIG. 1, there is shown a duplex laser printer 10 by way of example of automatic electrostatographic reproducing machines of a type like that of the existing commercial Xerox Corporation "DocuTech" printer shown and described in U.S. Pat. No. 5,095,342 suitable to utilize the internal purge stall-roll registration buckle chamber of the present invention. Although the disclosed method and apparatus is particularly well adapted for use in such digital printers, it will be evident from the following description that it is not limited in application to any particular printer embodiment. While the machine 10 exemplified here is a xerographic laser printer, a wide variety of other printing systems with other types of reproducing machines may utilize the disclosed internal purge buckle chamber for clearing jammed sheets.

Turning now more specifically to this FIG. 1 system 10, the photoreceptor is 128, the clean sheets 110 are in paper trays 120 and 122 (with an optional high capacity input path 123), the vertical sheet input transport is 124, transfer is at 126, fusing at 130, inverting at 136 selected by gate 134, and decurling at 116. There is an overhead duplex loop path 112 with plural variable speed feed rollers $N_1$–$N_n$ providing the majority of the duplex path 112 length and providing the duplex path sheet feeding nips; all driven by a variable speed drive 180 controlled by the controller 101. This is a top transfer (face down) system. Gate 225 selects between output decurler 116 and dedicated duplex return loop 112 here.

In this FIG. 1 embodiment, the endless loop duplex (second side) paper path 112 through which a sheet travels during duplex imaging is illustrated by the arrowed solid lines, whereas the simplex path 114 through which a sheet to be simplexed is imaged is illustrated by the arrowed broken lines. Note, however, that the output path leading to and beyond output decurler 116 and certain other parts of the duplex path 112 are shared by both duplex sheets and simplex sheets, as will be described. These paths are also shown with dashed-line arrows, as are the common input or "clean" sheet paths from the paper trays 120 or 122.

After a "clean" sheet is supplied from one of the regular paper feed trays 120 or 122 in FIG. 1, the sheet is conveyed by vertical transport 124 and registration transport 125 past image transfer station 126 to receive an image from photoreceptor 128. The sheet then passes through fuser 130 where the image is permanently fixed or fused to the sheet. After passing through the fuser, a gate 134 either allows the sheet to move directly via output decurler 116 to a finisher or stacker, or deflects the sheet into single sheet inverter 136. That is, if the sheet is either a simplex sheet, or a completed duplex sheet having both side one and side two images formed thereon, the sheet will be conveyed via gate 134 directly to output decurler 116. However, if the sheet is being duplexed and is then only printed with a side one image, the gate 134 will be positioned by sensors S-3 and S-4 and controller 101 to deflect that sheet into the inverter 136, where that sheet will be inverted and then fed through the duplex path to sheet transport 125 for recirculation back through transfer station 126 and fuser 130 for receiving and permanently fixing the side two image to the backside of that duplex sheet, before it exits via output decurler 116. All of the sheets pass through decurler 116.

Figure 2:
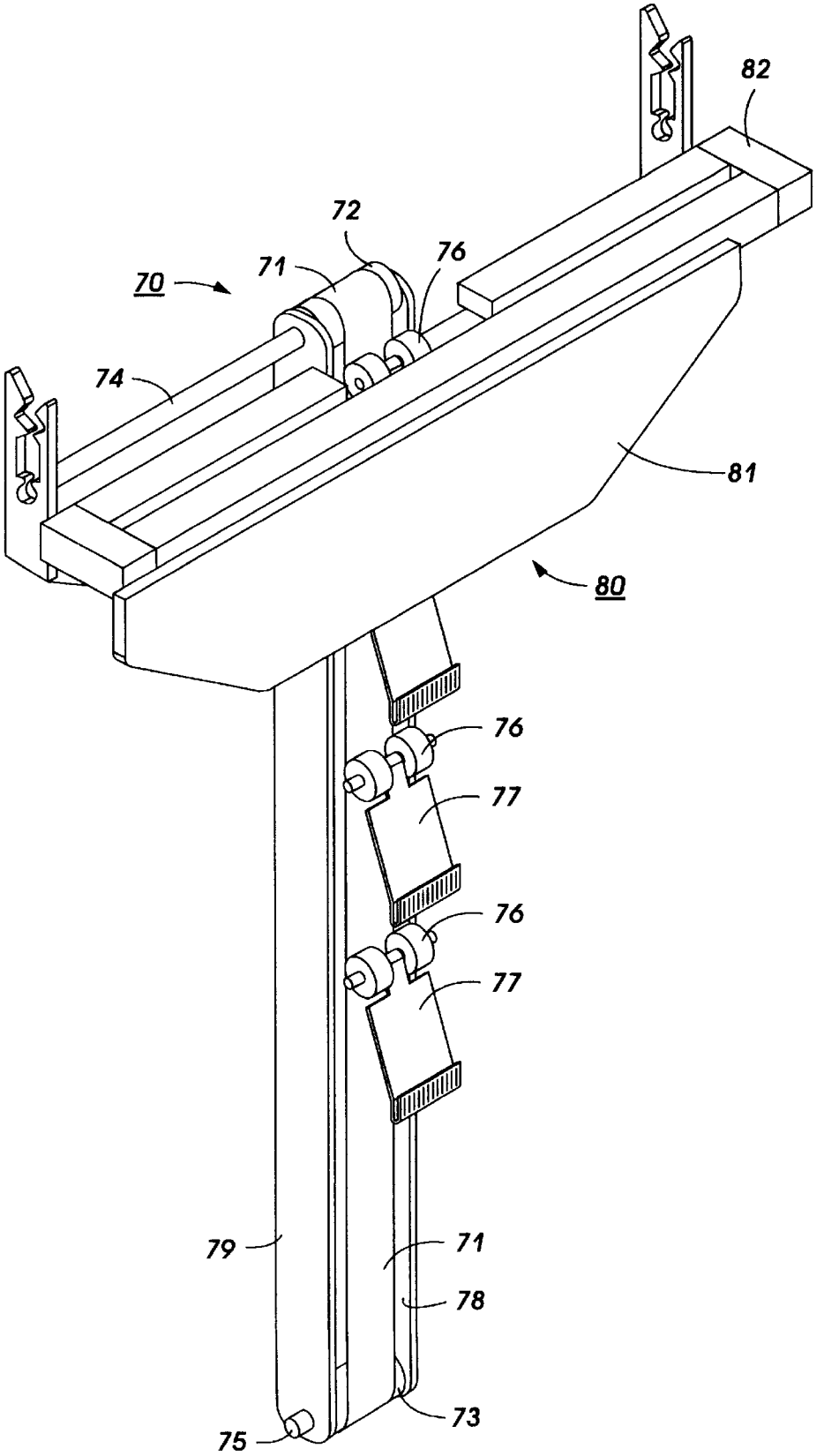
FIG. 2 is a perspective view of a portion of an operator accessible copy sheet transport used in the printing machine of FIG. 1.

A baffleless, T-shaped, operator accessible, copy sheet transport 70 is shown in FIG. 2 that is adapted to transport copy sheets either vertically from paper trays 120 and 122 and comprises a 25 mm wide neoprene timing belt 71 that is entrained around drive pulley 72 and idler pulley 73, mounted on rotatable shaft 74 and stationary shaft 75, respectively. Drive pulley 72 is mounted for rotation by shaft 74 in a counterclockwise direction in order to drive sheets in the direction of transfer station 126 as shown in FIG. 1. A conventional machine drive mechanism is connected to shaft 74 and controlled by controller 101. Timing belt 71 and driving and idler pulleys 72 and 73 are mounted on a frame members 78 and 79 which in turn are mounted on support structure 80, all of which are preferably made of plastic. Support structure 80 includes a member 81 parallel to and above timing belt 71 and a member 82 that is orthogonal to member 81 having a support bracket therein in which shaft 74 is mounted. Normal force is provided by idler rolls 76 attached to flat springs 77 mounted to a frame (not shown) that is fastened to a transport frame (not shown) which makes up the vertical transport assembly of copier/printer 10.

Baffleless, operator accessible, copy sheet transport 70 of FIGS. 1 and 2 improves both visual and physical access to the sheets in the unlikely event of a jam which must be cleared by an operator. It addresses the two most important aspects of jam clearance which are: (1) seeing the copy sheets that need to be removed; and (2) providing relatively uninhibited hand access for removing the sheet or sheets.

Figure 3:
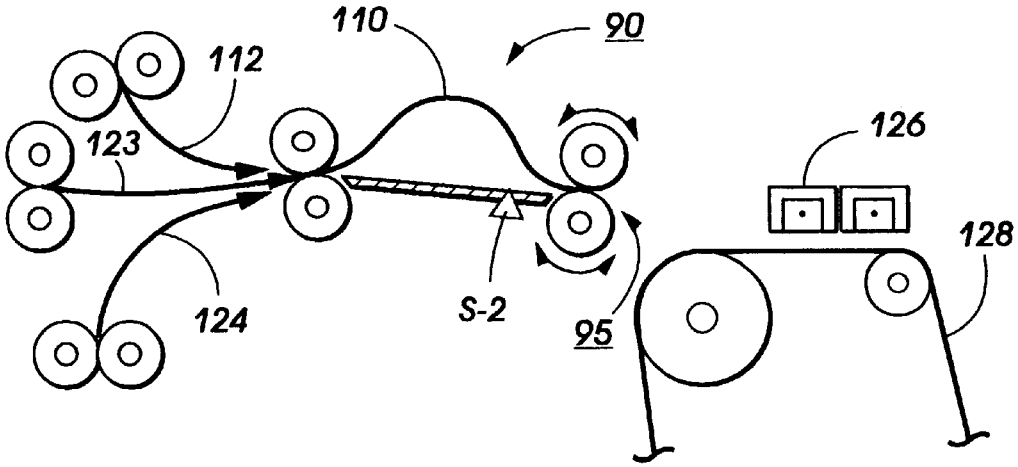
FIG. 3 is an enlarged, elevation view of the buckle chamber of the printer of FIG. 1 with a copy sheet buckled therein.

An open, operator accessible buckle chamber 90 is shown in FIG. 3 that takes copy sheet input from vertical transport 124, high capacity input path 123, and duplex path 112. Stall-roll registration nip 95 is used to buckle each copy sheet 110 within the chamber and thereby register the lead edge of each copy sheet for subsequent transport to transfer station 126.

Figure 4:
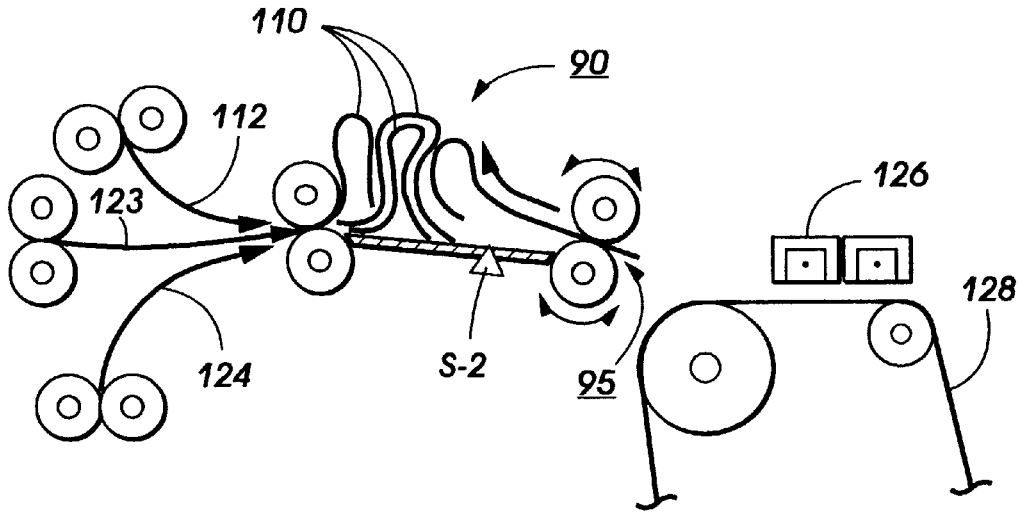
FIG. 4 is an enlarged, elevation view of the buckle chamber of the printer of FIG. 1 with copy sheets festooned therein.

In accordance with the present invention, as more specifically shown in FIG. 4, a jam detection and clearing system is included in printer 10 that comprises an enlarged, internal purge, buckle chamber 90 that is positioned immediately upstream of stall-roll registration pair 95, and copy sheet transport 70 that are controlled by controller 101. It should be understood that jam sensors could be placed at different or additional locations, as desired.

A sheet jam occurring in non-critical areas of the xerographic process will not cause a hard stop of the printer. Instead, all good copies downstream of the jam area will continue on through the processor until they have exited the printer, and then the processor will be stopped. As many as possible of the sheets elsewhere is the paper path will be accumulated at the stall-roll nip and in the buckle chamber for easy removal by the operator. If, however, the jammed sheet blocks the path of any sheets to the buckle chamber, or if circumstances of the fault require a hard shutdown, then sheets in addition to the jammed sheet may be prevented from reaching the buckle chamber, and the operator will be required to remove them in a more conventional manner. The feeding of new copy sheets will be stopped when the jam occurs so that only the sheets already in process will be festooned. That is, there is a cycle-out run during which the good copies are run out while the copies behind the jam zone are deliberately driven into the buckle chamber upstream of the jam zone for purging. By festooning all of the sheets in the buckle chamber during a jam condition for single point removal, the operator's time and activity conventionally required to remove all of the copy sheets from different parts of the process is minimized and job recovery is simplified. Festooning of sheets will occur in buckle chamber 90 because jams sensed downstream thereof can be used to stop the stall-roll registration pair 95 and cause the sheets to accumulate in the buckle chamber. The microcontroller 101 will always note where the various sheets are during the process operation, and when the jam has occurred, it will initiate the festooning of sheets in the buckle chamber by deactuating the stall-roll registration pair 95.

Buckle chamber 90 is configured with a large open area such that up to 6 sheets of letter size or three sheets of 17 inch paper can be stored therein. With open access buckle chamber 90, one can easily reach into the buckle chamber and remove the festooned sheets. Sheets compiled in the internal purge buckle chamber include: (1) sheets committed from any feeder; (2) sheets in transit from feeders 120 and 122 to stall-roll registration pair 95, sheets in the duplex loop; and (4) sheets diverted to the duplex loop by decision gate 225.

More particularly, in FIG. 1, jam sensors S1 through S6 are shown for sensing sheets locations during a printing operation. Any conventional sensor could be used, for example, U.S. Pat. No. 4,144,550. As sheets pass from either paper feeder 120 or 122 en route throughout the paper path of machine 10, sensors S1–S6 are actuated by controller 101 to sense the presence of a sheet according to a timing sequence. If a sheet is not sensed as having passed a particular sensor, a signal is transmitted to the controller which is connected to stall-roll registration pair 95 and the stall-roll registration pair is stopped to create bunching of sheets in buckle chamber 90. Upon receiving a signal indicating the absence of a sheet, controller 101 will either switch the printer to a "hard-stop", i.e., stop the printer completely, or switch the printer into its "soft-stop" mode which allows for sheets already in process downstream of the sensed jam area to continue out of the printer through output decurler 116. When a jam occurs in decurler 116 or en route to a finisher (not shown, but downstream of output decurler 116), all sheets upstream of buckle chamber 90 are festooned in the buckle chamber and sheets downstream of the buckle chamber are diverted by gates 134 and 225 around duplex loop 112 and then festooned in the buckle chamber. If there is jam during copying of side 1 of a duplexing operation, in order to maintain job integrity in the output device, sheets in the duplex loop are festooned in the buckle chamber along with any sheets upstream of the buckle chamber.

With the configuration in FIG. 1 of copier/printer 10, when a sheet that is part of a duplex operation is jammed in the finisher and backed up in output decurler 116, four sheets are in the paper path between feeder 120 and the exit of inverter 136. Two of these four sheets are already past stall-roll registration nip 95 and are diverted by gate 134 and 225 past output decurler 116 through the duplex path and into buckle chamber 90 where the two sheets from the vertical transport 124 that were positioned prior to stall-roll registration nip 95 are already festooned.

As shown more clearly in FIG. 4, stall-roll registration nip 95 may be reversed in order to festoon sheets into the buckle chamber 90 for easy removal by an operator. When a lead edge of a copy sheet is late in arriving at sensor S-3, a signal is sent to controller 101 indicating that the sheet has failed to strip from photoreceptor 128. Controller 101 takes the signal from sensor S-3 and, in turn, actuates DC motor driven reversible stall-roll registration nip 95 in a reverse or counterclockwise direction to retract the sheet which has entered the transfer area 126 back into buckle chamber 90 for easy removal with the other upstream sheets which are festooned there. Good copy sheets downstream of the mis-strip sheet are sent through output decurler 116 to the finisher (not shown).

While buckle chamber 90 is shown positioned in FIG. 1 adjacent to stall-roll registration nip 95, it is contemplated that the buckle chamber could be located at other positions within the paper path prior to the photoreceptor with DC motors being used to reverse copy sheets to such positions.

It should now be apparent that a method and apparatus used to clear jams in a machine includes an easily accessible internal purge buckle chamber where sheets are festooned during fault cycle downs whenever sheets are prevented from reaching the output in sequence by jammed sheets. A user can then clear most jams by accessing the jam area and then the easy to reach buckle chamber where internally purged sheets are gathered, thereby avoiding having paper distributed throughout the paper path.

While the embodiment shown herein is preferred, it will be appreciated that it is merely one example, and that various alterations, modifications, variations or improvements thereon may be made by those skilled in the art from this teaching, which is intended to be encompassed by the following claims:

What is claimed is:

1. In a method for printing document images onto sequential plural sheets sequentially moving downstream through an elongated sheet transport path, said sheet transport path including a sheet registration system at which said sheets may be temporarily stopped for registration, and said sheet transport path also having an enlarged and openly accessible buckle chamber upstream of said registration system in which said sheets may be buckled; and further including a sheet jam sensing system for sensing sheets jammed at different locations along said sheet transport path;

the improved method for removing said sheets from said sheet transport path, when said sheet jam sensing system senses jammed sheets, comprising:

in response to sensing a said jammed sheet at a location in said sheet transport path which is occurring downstream of said registration station, feeding plural said sheets in said sheet transport path which are upstream of said registration station downstream into said openly accessible buckle chamber, and buckling and festooning said plural upstream sheets within said openly accessible buckle chamber, and removing said plural sheets from said openly accessible buckle chamber.

2. The method of claim 1, wherein said sheet registration system automatically reverses a sheet being registered therein when a jam is so sensed so that said sheet will also be festooned within said buckle chamber.

3. The method of claim 2, wherein said sheet registration system comprises reversible registration rollers which are stalled for said temporarily stopping of said sheets for said registration.

* * * * *